US005827162A

United States Patent [19]

Rubin et al.

[11] Patent Number: 5,827,162

[45] Date of Patent: Oct. 27, 1998

[54] FOLDER/GLUER MACHINE FOR PAPERBOARD BLANKS

[75] Inventors: Ephraim Rubin, Philadelphia, Pa.; Raymond P. Lemore, Mt. Holly, N.J.

[73] Assignee: The Langston Corporation

[21] Appl. No.: 778,323

[22] Filed: Jan. 2, 1997

[51] Int. Cl.[6] ..... B31B 1/26; B31B 1/36

[52] U.S. Cl. ..... 493/178; 493/34; 493/72; 493/179; 493/436; 493/454

[58] Field of Search ..... 493/13, 14, 17, 493/18, 34, 72, 151, 131, 132, 178, 179, 436, 454

[56] References Cited

U.S. PATENT DOCUMENTS

| | | | |
|---|---|---|---|
| 4,254,692 | 3/1981 | Sardella | 493/179 |
| 4,741,728 | 5/1988 | Bakx | 493/178 |
| 5,035,683 | 7/1991 | Takeda | 493/179 |
| 5,041,070 | 8/1991 | Blaser | 493/14 |
| 5,417,638 | 5/1995 | Anderson | 493/18 |

*Primary Examiner*—Jack W. Lavinder
*Attorney, Agent, or Firm*—Seidel, Gonda, Lavorgna & Monaco, PC

[57] ABSTRACT

A device for folding paperboard blanks, the device including folding rails for supporting the blanks traveling through the device which define a path of travel for the blanks and a conveyor for conveying the blanks through the device. The device further includes a first operator side elongated helix folding assembly rotatably supported at each end, a second operator side elongated helix folding assembly rotatably supported at each end and aligned with the first operator side helix folding assembly, a first drive side elongated helix folding assembly rotatably supported at each end, and a second drive side elongated helix folding assembly rotatably supported at each end and aligned with the first drive side helix folding assembly. Actuators are connected to the ends of each second helix folding assembly for translating the ends either toward and away or above and below the blank path. A servo motor having a resolver may be connected to each helix folding assembly for rotating it to fold the blanks. An incremental motion controller which determines and stores the position of the helix folding assemblies from data obtained from the servo motor resolvers may also be provided. A target may be disposed on each helix folding assembly and a proximity sensor located adjacent each helix folding assembly for detecting the presence of its associated target for determining the home position of each helix folding assembly.

13 Claims, 10 Drawing Sheets

| FIG. 3A | FIG. 3B |
|---|---|

FOLDER/GLUER MACHINE FOR PAPERBOARD BLANKS

FIELD OF THE INVENTION

This invention relates to an apparatus for folding and gluing paperboard blanks (such as corrugated blanks or sheets) and in particular to an apparatus and method for automatically repositioning a helix blank contacting member when the machine is restarted and for automatically adjusting which panel is folded first in the final stages of folding.

BACKGROUND OF THE INVENTION

The apparatus for folding and gluing of corrugated blanks, typically called a folder/gluer, is used in the corrugated board industry to convert a cut-out blank into a corrugated box. The folder/gluer is typically grouped as one in a series of machines operating in timed relationship to convert paperboard blanks, one-by-one, into boxes. The folder/gluer usually receives its feed from a creasing/slotting unit or a rotary die-cutter which receives its feed directly or indirectly from a feeding unit. Between the feeding unit and the creasing/slotting unit or the rotary die-cutter can be one or more printing units. After the folder/gluer there is usually a counter/ejector. The folder/gluer ordinarily receives a blank with four side-by-side panels which are separated from one another by longitudinal creases and slots and with a glue tab associated with one of the outboard panels. The folder/gluer applies glue to the glue tab and folds each outboard panel relative to an adjacent inboard panel along the intervening crease and discharges flattened tube-shaped boxes.

It has been recognized to have a folder/gluer mechanism having a conveyor mechanism, a plurality of elongated helix folding assemblies for folding paperboard blanks and a mechanism to rotate each of the elongated helix folding assemblies. By using such a folder/gluer, the chance of "fish tailing" is substantially reduced independently of speed matching, the chance of folding in a cross machine direction is substantially eliminated, and folding is carried out smoothly (rather than abruptly) without any impacting force being applied.

The folder/gluer folds paperboard blanks fed one by one in timed sequence into the machine. The blanks each have a first panel and a second panel which is separated from the first panel by an intervening crease. The first panel is folded with respect to the second panel along the intervening crease from an initial angular relationship between the panels, denoted herein as an entrance angle (the angle included between the first and second panels as the blank enters the folding operation), to a resulting angular relationship between the panels, denoted herein as an exit angle (the angle included between said first and second panels as the blank leaves the folding action).

The conveyor of the folder/gluer is adapted to transport the blanks one-by-one in a direction of travel with the second panel of each blank being moved along a plane of travel. The elongated helix folding mechanism has an elongated helix blank contacting member and a shaft which supports the helix blank contacting member. The helix blank contacting member has a longitudinal axis extending generally in the direction of travel. The shaft extends coaxially with and is rotatable about the longitudinal axis to cause rotation of the helix blank contacting member about the longitudinal axis. The mechanism rotating the elongated helix folding member includes a servo motor mounted to the shaft to rotate the shaft such that the helix blank contacting member is rotated about its longitudinal axis. The shaft has ends positioned to accommodate the entrance angle between the first and second panels and to fold the first panel until preselected exit angle between the panels is attained.

The prior art conveyor improved upon its prior art by improving the manner in which the panels were folded. The prior art conveyor initially contacts the first panel solely at an interior portion thereof and without impact and maintains continuous contact between the helix contact member and the interior portion of the first panel during the entire folding process. This resulted in smooth folding of the panels.

One of the shortcomings of the prior art devices is that when a blank jams in the folder/gluer or the machine is turned off for some other reason, the machine must be reset using set-up procedures and cannot begin from where it left off.

It is, thus, desired to be able to automatically reposition the helix blank contacting member when the machine is restarted. In addition, it is desired that the operator be able to automatically adjust which flap is folded first during the final stages of folding.

SUMMARY OF THE INVENTION

One object, feature, and advantage of this invention resides in an incremental motion control (IMC) which stores the position of the servo motors and associated elongated helix assembly through use of resolvers such that the elongated helix assemblies do not have to be re-initialized after stopping.

Another object, feature, and advantage of this invention resides in the automatic movement of the elongated helix assembly through the actuators or the servo motor so that the proper flap folds first depending on the location of the glue tab and whether the glue tab should be located inside or outside the formed box.

Further objects, features, and advantages of the present invention will become more apparent to those skilled in the art as the nature of the invention is better understood from the accompanying drawings and detailed descriptions.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 3C depicts the relationship between FIGS. 3A and 3B;

DETAILED DESCRIPTION OF THE INVENTION

Figure 1:
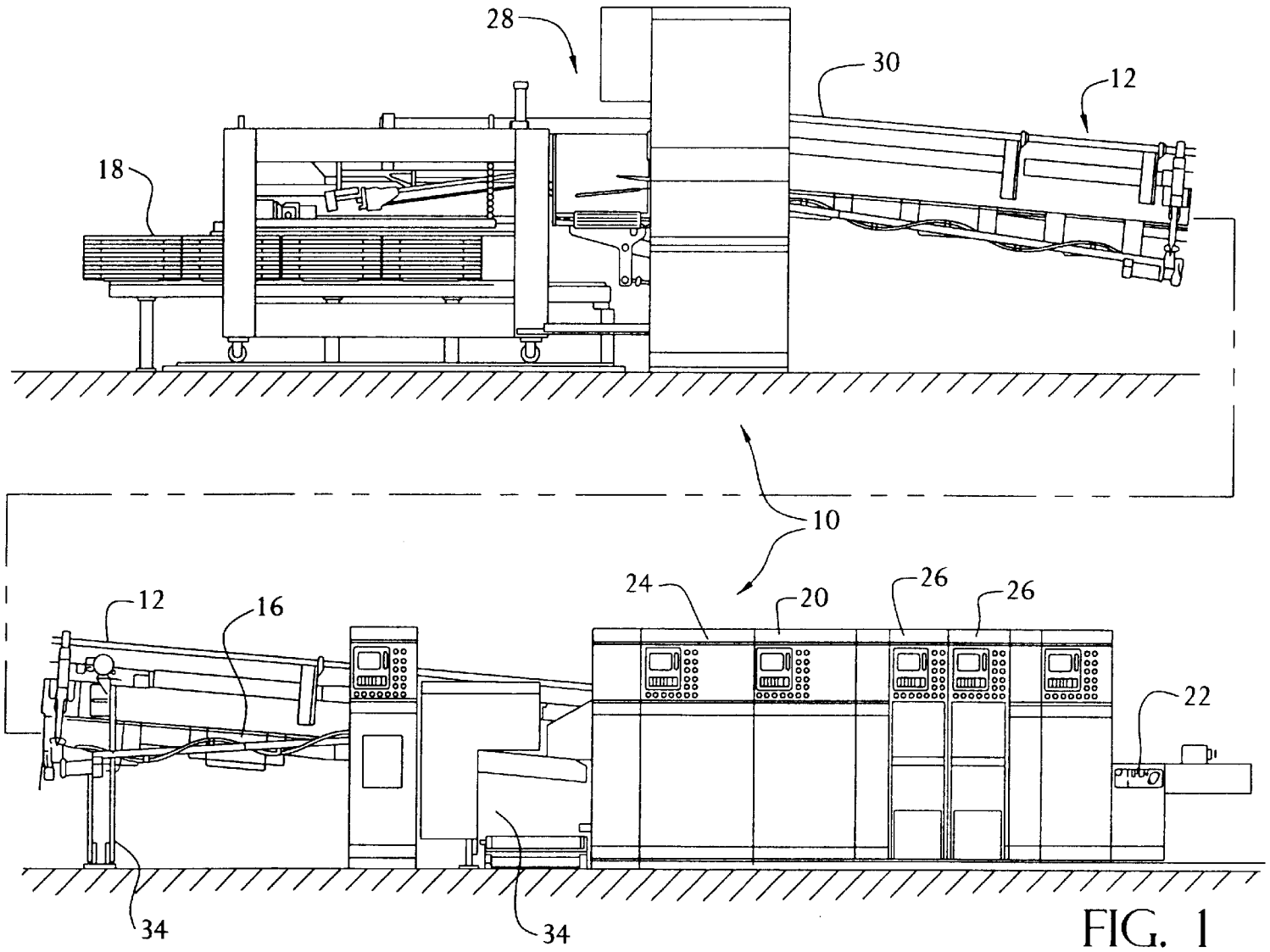
FIG. 1 is a side view of the apparatus in the context of a flexo-folder gluer machine.

Referring to the drawings in detail, where like numerals indicate like elements, there is illustrated a flexo-folder gluer device in accordance with the present invention designated generally as 10. Referring to FIG. 1, a folder/gluer 12, is grouped as one in a series of machines operating in timed relationship in the flexo-folder gluer 10 to convert a plurality of paperboard blanks 16, one-by-one, into a plurality of collapsed boxes 18.

The folder/gluer 12 receives its feed from a rotary die-cutter 24 which receives its feed indirectly from a feeding unit 22. Between the feed unit 22 and the rotary die-cutter 24, in the embodiment shown in FIG. 1, is a creasing/slotting unit 20 and a plurality of printing units 26. In the embodiment shown, a counter/ejector 28 is located after the folder/gluer 12. The flexo-folder gluer 10 is modular and allows units which are not required in a particular installation to be removed.

Typically, the flexo folder gluer 10 is operated by a single drive or a split drive system having a pair of drive motors (not shown). Typically, one of the drive motors is located in the rotary die-cutter unit 24 and the second is located in the folder/gluer 12. The first drive motor drives the feeding unit 22, the printing units 26, and the creasing/slotting unit 20. The second drive motor drives the folder/gluer 12, as explained below, and the counter/ejector 28.

The second drive motor transmits power to the counter/ejector 28 via an input shaft 30. The speed of the input shaft 30 and the entire operating sequence of the machines are controlled with the drive motors such that the entire series of machines is operated synchronously. As discussed in further detail below, certain elements are controlled independently of the motors.

Referring to FIGS. 2 and 3A–3C, the folder/gluer 12 has a pair of upper side rails 32 on each side and a plurality of movable legs 34 as the main structural elements. Each upper side rail 32 comprises a folding entrance rail 36 and a folding exit rail 38 which are joined together with a splice plate 40. The side rails 32 and the legs 34 are capable of moving inboard, outboard, and perpendicular to the path of the blank 16 to adjust the width of the folder/gluer 12 in relation to the width of the center panels of the blank 16, as explained below.

Figure 4:
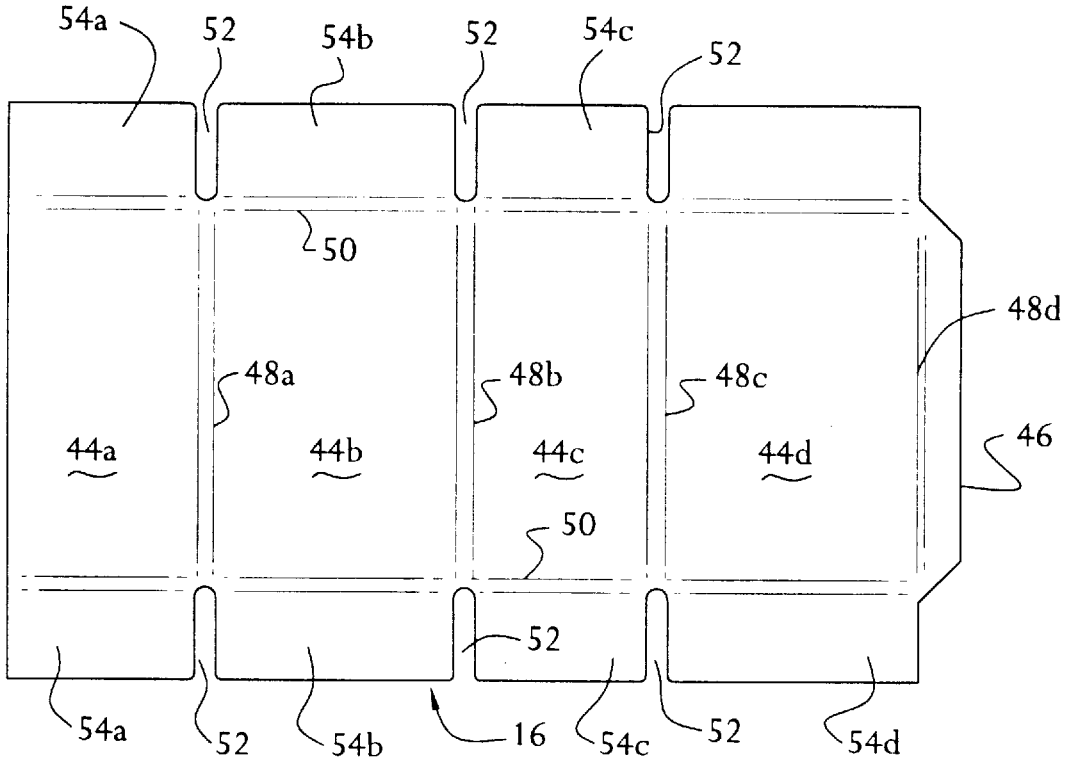
FIG. 4 is a plan view of a blank.

In FIG. 4, the blanks 16 are depicted. Each blank 16 includes four side-by-side panels 44*a–d* and a glue tab 46 which are separated by longitudinal creases 48*a–d*. Each panel 44*a–d* includes transverse corrugator score lines 50 and slots 52 which define flaps 54*a–d*. The longitudinal creases 48 and the slots 52 are formed upstream of the folder/gluer 12 in the creasing/slotting unit 20. The glue tab 46 is cut in the rotary die cutter 24.

During the folding operation of the folder/gluer 12, the outboard panel 44*a* is folded with respect to the inboard panel 44*b* along the intervening crease 48*a* and the outboard panel 44*d* (and associated glue tab 46) is folded with respect to the inboard panel 44*c* along the intervening crease 48*c*.

Figure 2:
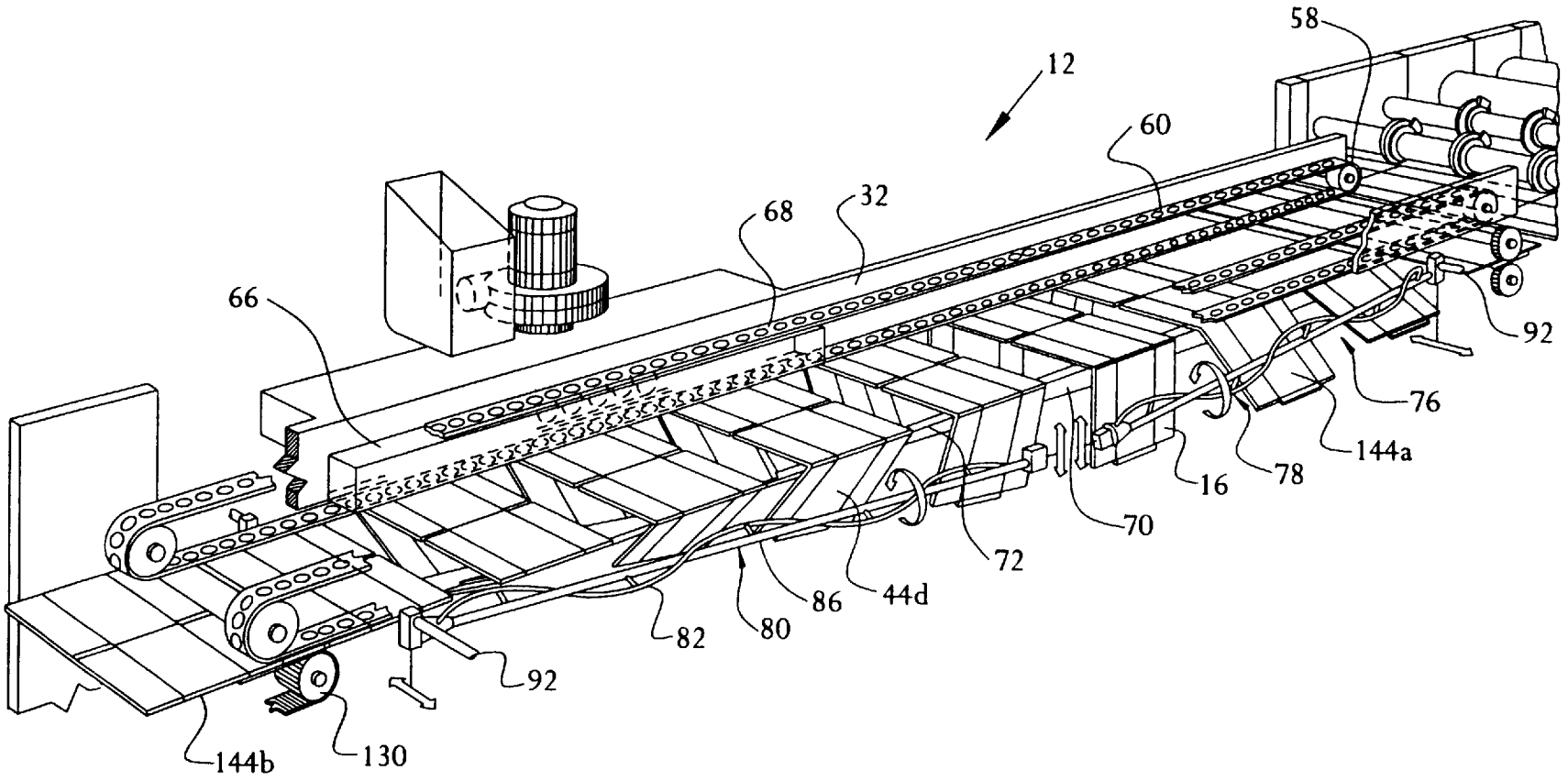
FIG. 2 is a perspective view of the apparatus.
Figure 5:
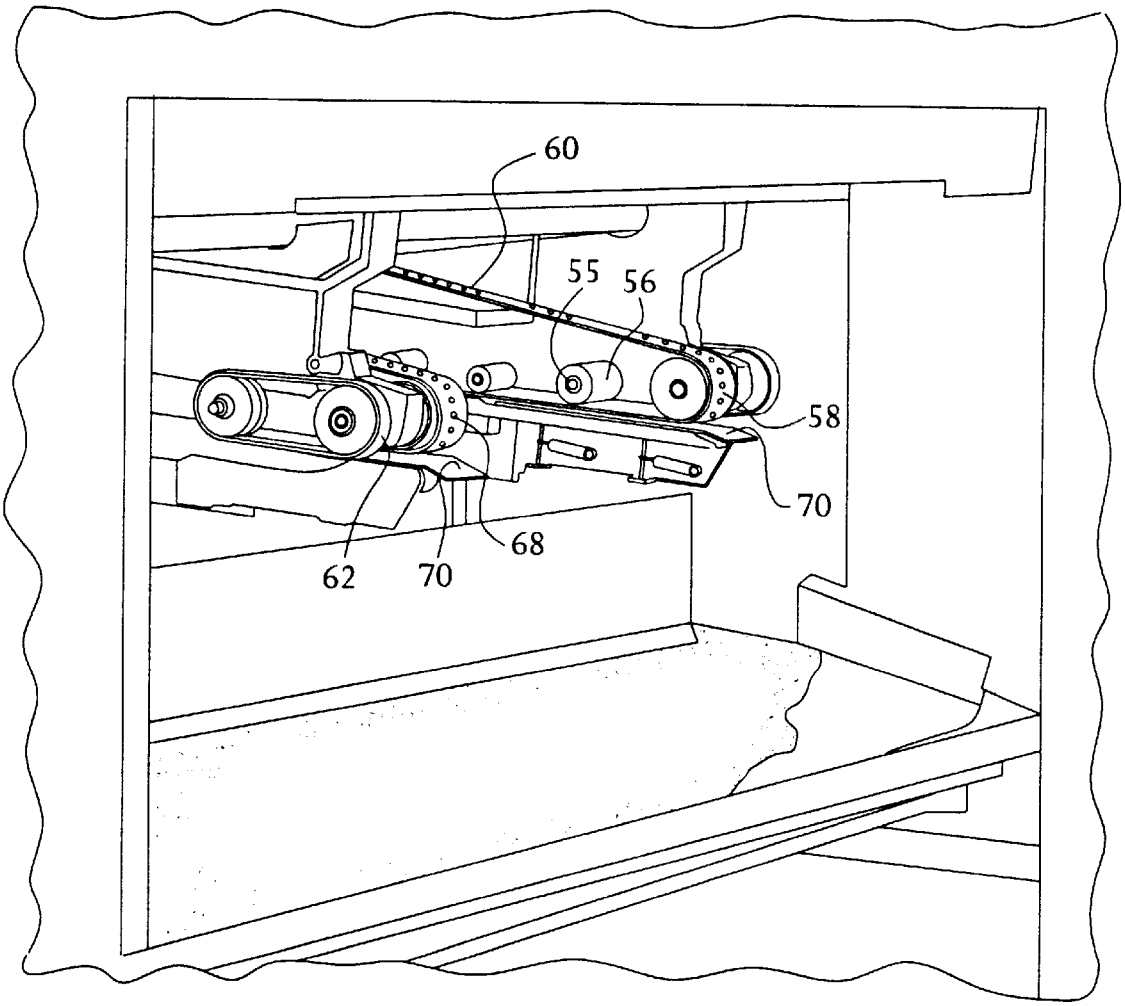
FIG. 5 is a perspective view of the feed end of the folder/gluer.

Referring to FIGS. 2 and 5, bearings 55 are supported on the inboard side of each upper side rail 32. Rotatably supported on each bearing 55 is an upper roller 56. A plurality of rollers 56 are located along each upper side rail 32, forming a set of upper rollers 56 on each side of the folder/gluer.

Trained on each set of upper rollers 56 and over a turn-around roller 58 is a conveyor belt 60. Each conveyor belt 60 is driven by a pulley 62. The pulleys 62 are driven by the second drive motor (not shown) via an input shaft 30. Each belt 60 has a narrow width (e.g., 4 inches) and a high coefficient of friction surface (e.g., polyurethane rubber or the like) which enables the belt 60 to engage and grip the blanks 16 to move them through the folder/gluer 12. The conveyor belt 60 is continuous and does not require synchronization with the first drive motor or associated units upstream (e.g., the creasing/slotting unit 20, rotary die-cutter unit 24, etc.).

The folder/gluer 12 has a vacuum box 66 located at the exit, or downstream, portion of the folder/gluer 12. Each conveyor belt 60 passes under one of the vacuum boxes 66 and has a plurality of holes 68 through which the vacuum is drawn to hold the blanks 16 during their final folding, as explained below in greater detail.

The folder/gluer 12 has a pair of folding rails 70. Each of the folding rails 70 extends from the entrance of the folder/gluer 12 adjacent to the rotary die-cutter 24 for approximately three-quarters of the length of the folder/gluer 12, i.e., approximately to the mid-point of the second helix assembly 80. The inner panels 44*b* and 44*c* of the blanks 16 pass over the folding rails 70. The folding rails 70 are inboardly and outboardly adjustable such that the distance between their outer edges is equal to the combined width of the two inner panels 44*b* and 44*c* of the blank 16. The folding rails 70 support the blanks 16 until the blanks 16 reach the portion of the folder/gluer 12 where the vacuum box 66 is located.

Figures 3A, 3C:
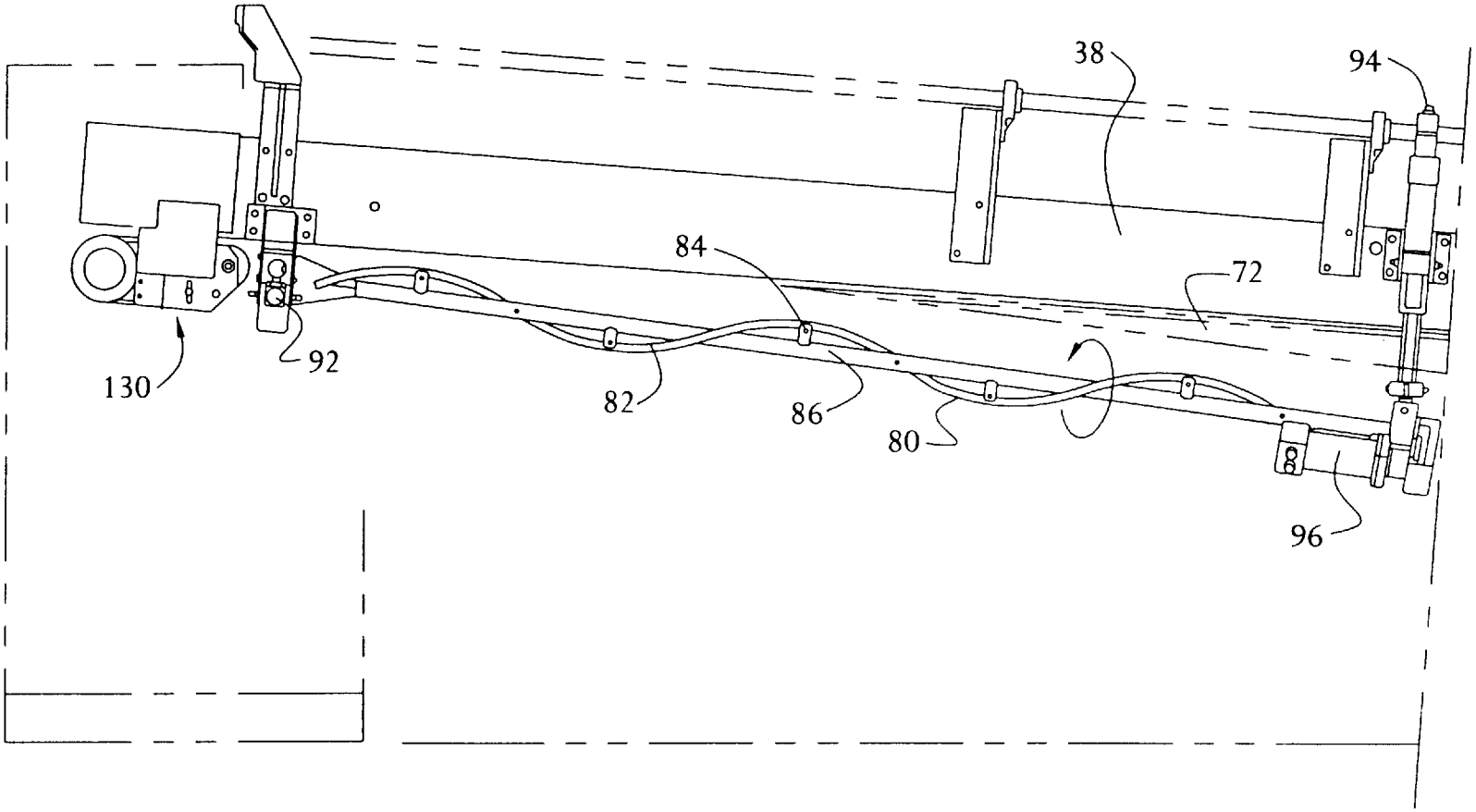
FIGS. 3A, 3B, and 3C are side views of the apparatus.
Figure 3B:
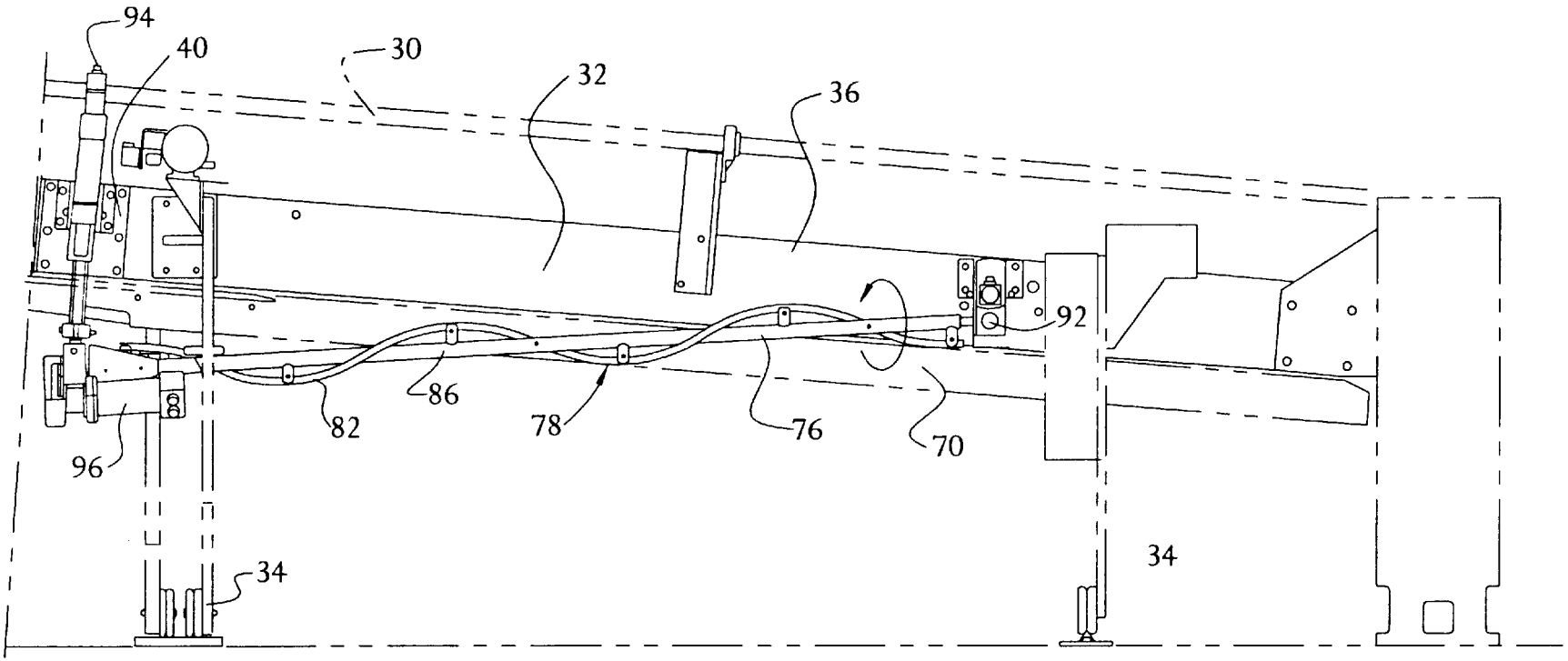

Each folding rail 70 has a tapered end 72, as best seen in FIG. 3A. The tapered end 72 terminates sufficiently prior to where the folding process is completed so it does not become trapped inside the completed fold of the blank 16. Each tapered end 72 is positioned to underlie one of the conveyor belts 60. The folding rails 70, including the tapered ends 72, function to press the blanks 16 passing thereover against the adjacent conveyor belt 60 to assure good gripping contact between the belt 60 and the blanks 16. In the portion where there is no folding rail 70, the vacuum created by the vacuum box 66 ensures that the blank 16 is in good gripping contact with the conveyor belt 60 for the final folding stage.

Referring to FIGS. 2 and 3, the folder/gluer 12 has a plurality of elongated helix folding assemblies 76 one located on the operator side and the other located on the drive side of the folder/gluer 12. The drive side helix assemblies are only partially seen in FIG. 2. Each helix assembly 76 comprises a first helix folding assembly 78 and a second helix folding assembly 80. The first and second helix folding assemblies 78 and 80 on the drive side are generally symmetric about the board travel line to those shown on the operator side and rotate in a clockwise direction. The first and second helix folding assemblies 78 and 80 each have a shaft 86, a plurality of spokes 84 extending from the shaft 86, and a helix blank contacting member 82 supported by the spokes 84. The shaft 86 extends coaxially with the longitudinal axis of the contacting member 82. Preferably, each helix blank contacting member 82 forms a cylindrical helix winding around the shaft 86 which has preselected radius and pitch.

The "radius" is the radius of the enveloping cylinder. The "pitch" is the axial distance (length of axis) needed for the helix to wind around its axis exactly once. The helix blank contacting members 82 are preferably constructed to have a low friction surface (e.g., of nylon).

The embodiment described herein depicts a folder/gluer in which the outboard panels of the blanks are folded downward and then upward under the center portion of the blank. This is commonly referred to as a "down folder," that is, the second panel is supported from above. U.S. Pat. No. 4,254,692 entitled "Helix Folder for Paperboard Blanks" describes an apparatus which uses a single set of elongated helix folding means for folding the outboard panels of the blanks from an upward position, via a stationary rail, downwardly over the center portion of the blank. This is commonly referred to as an "up folder," that is, the second panel is supported from below. The choice between folding under as opposed to folding over or over generally depends on whether printing has been done on the topside or the bottomside of the board. For example, in the instant invention the printing would be done on the topside. U.S. Pat. No. 4,254,692 is hereby incorporated herein by reference.

Figure 6:
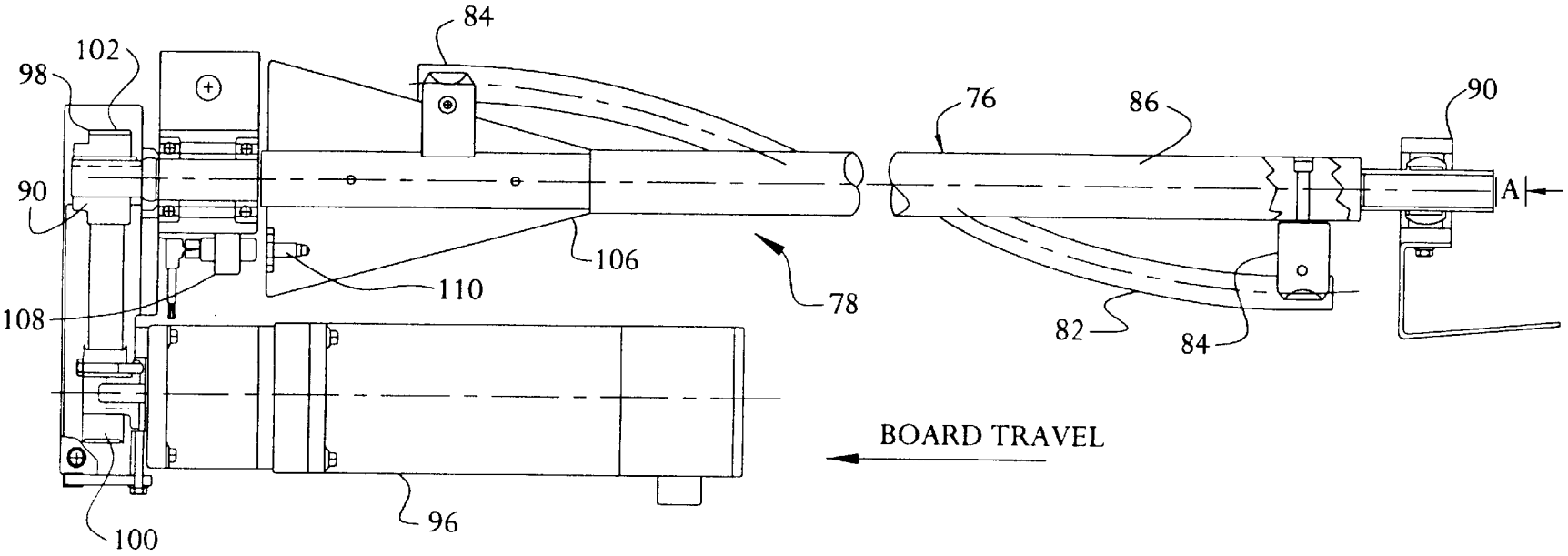
FIG. 6 is a side view of a first helix assembly with portions broken away.
Figure 7:
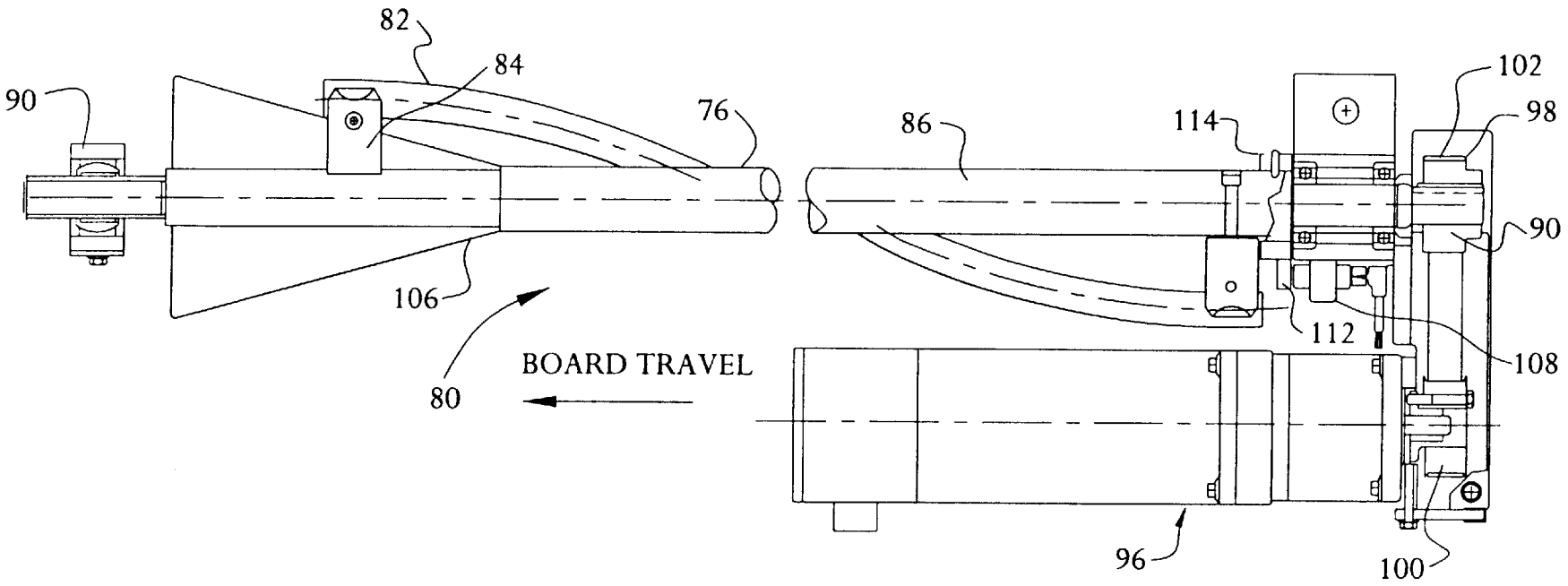
FIG. 7 is a side view of a second helix assembly with portions broken away.

Referring to FIGS. 6 and 7, the shaft 86 of each helix assembly 76 is rotatably supported at its inner and outer ends by a bearing 90. The outer actuators 92 are located on the outer ends of shafts 86 while the inner actuators 94 are located on the inner ends thereof. As best seen in FIG. 3, a plurality of actuators 92 and 94 connect the bearings 90 to the upper side rail 32. The actuators 92 move their respective helix assembly 78 or 80 in a generally horizontal direction inwardly and outwardly. The actuators 94 move their respective helix assembly 78 or 80 in a generally vertical direction upwardly and downwardly.

A servo motor 96 with a reducer is located at the inner end of each of the shafts 86 for driving the helix assemblies 78 and 80. Each servo motor 96 is connected to the shaft 86 through a pair of timing pulleys 98 and 100 and a timing belt 102. Each servo motor 96 rotates one of the helix contact members 82.

Each first and second helix assembly 78 and 80 has a cone 106 located at the exit end of the shaft 86. The cone 106 has a base radius slightly larger than the radius of the helix blank contact member 82.

Each helix assembly 76 has a proximity sensor 108 located directly below the centerline of the shaft 86. On the first helix assembly 78, the proximity sensor 108 has a target 110 located on the cone 106. On the second helix assembly 80, the proximity sensor has a target 112 located on a ring 114 which is mounted to the shaft 86. Each proximity sensor 108 is able to detect its associated target 110 or 112 to define the "home" position of the helix blank contact member 82.

The shafts 86 of each helix folding assembly 76 are positioned using the actuators 92 and 94 so that the common longitudinal axis of each shaft 86, and its associated blank contacting member 82, extends generally in the direction of board travel and is generally parallel to the plane of folding of the blanks 16. The entrance (upstream) end of each shaft 86 is positioned to accommodate the entrance angle of the blank 16. The exit (downstream) end of each shaft 86, with the cone 106 is positioned to fold the panels of the blank 16 until the preselected exit angle is reached.

The shafts 86 are preferably positioned so that their associated blank contacting member 82 contacts the first panel of the blank, preferably in the center thereof, in the blank (board) travel direction and the inboard/outboard direction. The controlling of the actuators 92 and 94 is done with a programmable logic control (PLC) 118 and a micro computer (MC) 120 (depicted in FIG. 8), as described below.

Figure 8:
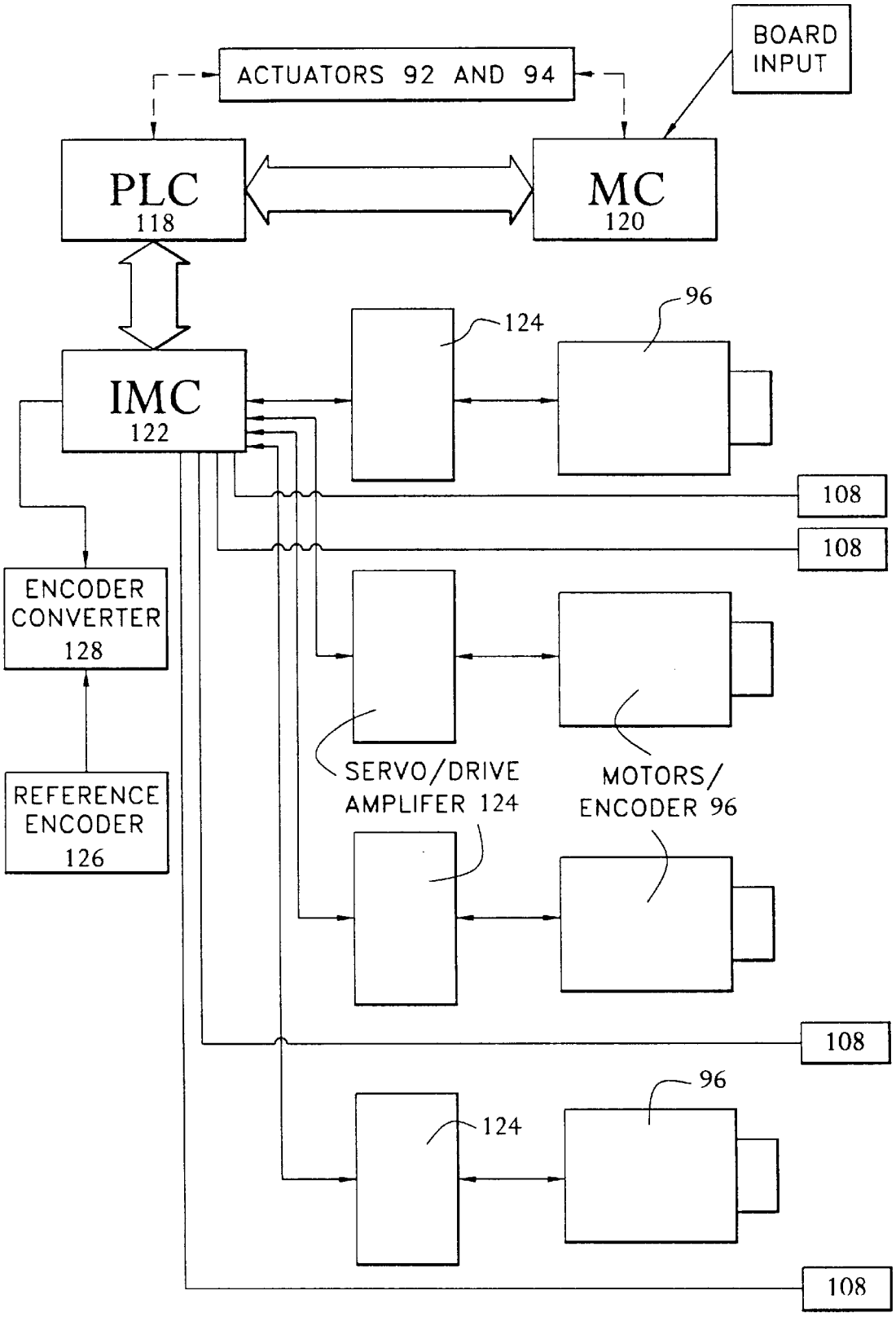
FIG. 8 is a schematic of the interrelation of the controllers.

Referring to FIG. 8, each servo motor 96 has a resolver and is connected to an incremental motion controller (IMC) 122 through a servo drive/amplifier 124, such as an Allen Bradley 1391 with an "AQ2" Quadratre. The proximity sensors 108 are also connected to the IMC 122. The IMC 122 receives a reference position of the flexo folder gluer 10 from a reference encoder 126 located at the feed unit 22, as seen in FIG. 1, of the flexo-folder gluer 10. The signal of the reference encoder 126 is forwarded through an axis link encoder converter 128, such as an Allen Bradley ALEC. The IMC 122 also receives information related to such parameters as board dimension from the micro computer (MC) 120 via the programmable logic control (PLC) 118.

Turning now to the operation of the flexo-folder gluer 10 in general, and in particular the folder/gluer 12, the blanks 16 are fed into the feed unit 22 of the flexo-folder gluer 10 as rectangular shaped corrugated board with transverse corrugator score lines 50. The creasing/slotting unit 20 forms the longitudinal creases 48*a–d* and slots 52 of each blank 16, defining the four side-by-side panels 44*a–d*. The rotary die cutter 24 shapes the glue tab 46. By the time the blanks 16 reach the folder/gluer 12, the blanks 16 are in the form shown in FIG. 4. The blanks 16 are moved along the folder/gluer 12 by the conveyor belt 60 which is driven by the second drive motor via the shaft 30 and the pulley 62.

While not synchronized, the conveyor belt 60 is required to maintain a board travel rate which is typically the same as that of the upstream machines and ordinarily ranges, for example, from 1 to about 400 blanks per minute, and preferably ranges from about 20 to about 200 blanks per minute. The spacing between the blanks 16 (forward edge to forward edge) is programmed into the folder/gluer 12 based on the upstream units of the flexo-folder gluer 10 and is usually the same as the circumference of the printing cylinder of the printing unit 26.

Included at the upstream end of the folder/gluer 12 is a glue applicator (not shown) which applies glue to the glue tab 96. The glue applicator has a glue supply hose, a nozzle, and an electric eye mechanism for signaling the nozzle to operate. A curved bar is provided to support the underside of the blank as the glue is applied.

While the actuators 92 and 94 can be controlled either by the PLC 118, the microcomputer (MC) 120, or both, the actuators are preferably controlled by the PLC 118. The size of the blank 16 and the size of each panel 44 are typically stored in the micro computer (MC) 120 which controls the actuators 92 and 94.

At the initiation of operation, the actuators 92 and 94 position the ends of each shaft 86 of each helix folding assembly 76 to have their contact members 82 contact the outboard panel 44*a* or 44*d* of the blank 16 in the center in both the blank (board) travel direction and the inboard/outboard direction. Each servo motor 96 rotates its respective helix assembly 78 and 80 until the proximity sensors 108 detect their respective target 110 and 112 to determine the exact position of their associated helix blank contact members 82 and define a "home" position. The IMC 122, using information concerning the blank 16 and the number of units (e.g., print station, rotary die-cutter) from the PLC 118 and the micro computer (MC) 120, controls the servo motors 96 via the servo/drive amplifiers 124 to position the helix blank contact member 82 to the proper set-up position for engaging the panels 44*a* and 44*d*.

As indicated above, outboard panel 44*a* is folded with respect to inboard panel 44*b* along the intervening crease 48*a* and outboard panel 44*d* (and associated glue tab 46) is folded with respect to inboard panel 44*c* along the intervening crease 48*c*. The blanks 16 are fed seriatim, in timed sequence, into the upstream end of the flexo-folder gluer 10 and thereafter enter the folder/gluer 12 in properly spaced relation. Each blank 16 is supported by the folding rail 70 and is engaged above by the conveyor belt 60. The conveyor 60 moves the blank 16 through the folder/gluer 12 at the synchronized speed. As a blank 16 enters the folder/gluer 12, glue is applied to the glue tab 46 by the glue applicator (not shown).

As the belts 60 convey a blank 16 through the apparatus, the inboard panels 44*b* and 44*c* are supported in the plane of travel by the rails 70. The blank 16 is initially engaged, without impact, at an interior portion of each outboard panel 44*a* and 44*d* by the helix blank contact member 82. (The actuators 92 and 94 have been adjusted, if necessary as indicated above, to provide the appropriate initial contact point.)

The helix blank contact members 82 contact the outboard panels 44*a* and 44*d* of the blank 16 as it enters the folder/gluer 12, causing the panels 44*a* and 44*d* to swing relative to the adjacent inboard panel 44*b* and 44*c*, respectively, along the crease 48*a* and 48*c*, respectively. In down folders, gravity assists in the initial folding of the panels, especially in large boxes.

The servo motors 96 which are operated in a torque mode by the servo/drive amplifiers 124, rotate the contact member 82. The IMC 122 determines the position of a blank 16 traveling through the folder/gluer 12 by comparing the data received from the reference encoder 126 and the position of the contact member 82 obtained from the resolver of the servo motor 96 via the servo/drive amplifier 124.

As the blank 16 continues to travel through the folder/gluer 12 and with the outer panels 44*a* and 44*d* projecting generally downward, the helix contact members 82 of the first and second helix assemblies 78 continue to progressively fold the outboard panels 44*a* and 44*d* of the blank 16 until each outboard panel 44*a* and 44*d* is adjacent to its respective inboard panel 44*b* and 44*c*.

The order of the final fold is dependent upon whether the glue tab 46 is desired to be inside or outside of the box, and whether the glue tab 46 is located on the operator or drive side of the machine, as described below. Typically, the glue tab 46 is to be located on the inside of the box 18 with the glue tab 46 on the operator side of the machine (see FIG. 2). In such a situation, the operator side outboard panel 44*d* is folded to underlie the adjacent inboard panel 44*c* and then the drive side outboard panel 44*a* is folded to underlie the adjacent inboard panel 44*b*. The glue flap 46 is then glued to the panel 44*a*, forming a closed flat tube. Of course, there are situations where it is desired to have the glue tab 46 glued to the panel 44*a* on the outside of the box 18 such that the interior of the box 18 is relatively smooth or to have the glue tab 46 located on the drive side of the machine.

The tapered ends 72 of the folding rail 70 terminate prior to the end of folding operation so as not to interfere with the completion of the folding. The flattened tube is then conveyed by belts 64 below take-off rollers 130 which maintain the tube in flattened form and which feed each flattened tube to a downstream apparatus, such as the counter/ejector 28 in FIG. 1. As best seen in FIG. 2, a blank being folded by rotating helix members 82 is denoted by reference 144*a* and a blank which has been completely folded and which is leaving under the influence of take-off rollers 130 is denoted by reference 144*b*.

Occasionally the flexo folder gluer 10 has to be stopped in the middle of its operation when blanks 16 are still located within the machine, such as when there is a jam. During a jam condition (JC), the drive motors are stopped; however, power is maintained to the servo motors 96, the IMC 122, and the servo/driver amplifier 124, and other non-relevant devices.

When safety gates, not shown, are opened, power to the servo motors 96 in that area is removed, but power to the resolver of the servo motor 96 and to the power portions of the servo/drive amplifier 124 is still maintained. In an emergency condition (EC), the drive motors are stopped and power is removed from the servo motors 96 and other devices; however, power to the resolver of the servo motor 96 and portions of the servo/drive amplifier 124 which determine the position of the helix folding assembly 76 are maintained.

Upon starting up after clearing the jam condition or correcting the situations which caused the emergency condition, the IMC 122 determines the position of the various units driven by the first drive motor (e.g., the creasing/slotting unit 20, the rotary die-cutter 24, etc) from information received from the reference encoder 126 via the encoder converter 128. The IMC 122 determines the position of each helix folding assemblies 76 from the resolver of the servo motor 96 via the servo/drive amplifier 124. This permits the IMC 122 to move each contact member 82 to its proper position, via the servo motor 96, without having to re-initialize each of the elongated helix folding assemblies 76. This is possible even if one or more of the helix assemblies 78 and 80 were moved to remove the jam or resolve the problem. Thus, upon re-start, the IMC 122 is able to position the helix folding assemblies 76 so that the drive motors can start up and continue operation of the flexo-folder gluer 10.

If the entire flexo folder gluer 10 is shut down or loses power such that the resolver does not have power, the IMC 122 rotates the helix assemblies 78 and 80 until the proximity sensor 108 locates its respective target 110 or 112 to define the "home" position. Once the "home" position is determined, the IMC 122 determines the position of the helix assemblies 78 and 80 via the resolver of the servo motor 96 and the servo/drive amplifier 124.

Figure 9:
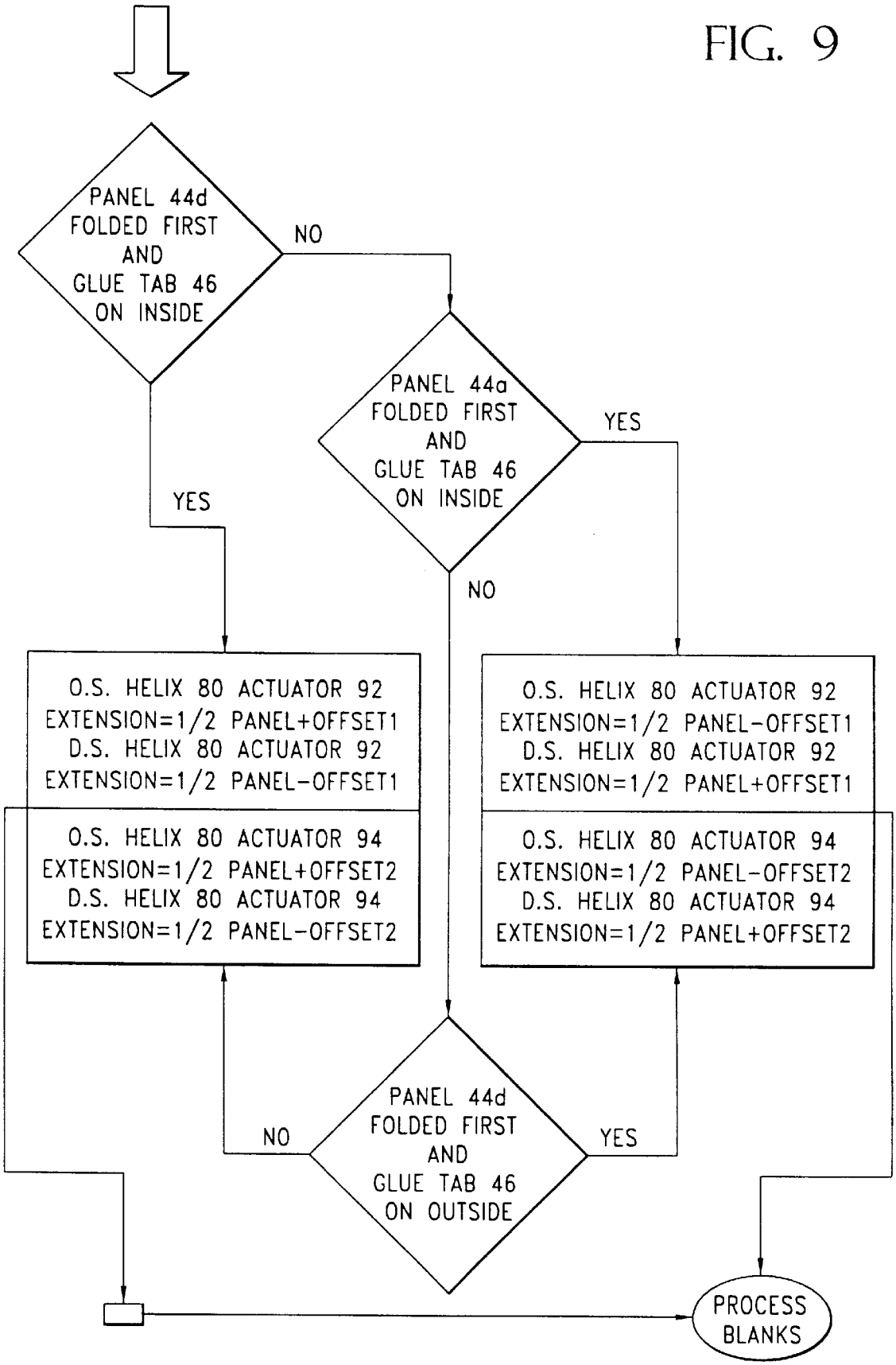
FIG. 9 is a flow diagram of the method for determining the movement of the second helix assembly for positioning the glue flaps in accordance with the present invention.

FIG. 9 depicts a flow diagram which illustrates the logic for controlling the movement of the actuators 92 and 94 on the second helix assembly 80 to determine the folding order of panels 44*a* and 44*d*. Depending on where the glue tab 46 is located (i.e., operator side or driver side) and whether it is desired to have the glue tab 46 located inside or outside the completed box 18, either the panel 44*a* or the panel 44*d* is required to reach the folded position first.

The PLC 18 and the microcomputer 120 automatically adjust the extension of the actuators 92 and 94 of the second helix assembly 80 depending upon the size of the blank 16, the location of glue tab 46, and the final position of the glue tab 46 inside or outside of the box.

As shown in FIG. 9, if the panel 44*d* is desired to be folded first with the glue tab 46 on the inside of the completed box 18, then the actuator 92 of the operator side (O.S.) helix 80 is extended by the distance of half a panel width plus a first offset and actuator 92 of the drive side (D.S.) helix 80 is extended by the distance of half a panel width minus the first offset. Similarly, if panel 44*a* is desired to be folded first with the glue tab 46 on the inside, then the actuator 92 of O.S. helix 80 is extended by the distance of half a panel minus the first offset, whereas the actuator 92 of D.S. helix 80 is extended by the distance of half a panel plus the first offset.

In contrast, if the panel 44*d* is desired to be folded first with the glue tab 46 on the outside of the completed box 18, then the actuator 94 of the O.S. helix 80 is extended by the distance of half a panel width plus a second offset and the actuator 94 of D.S. helix 80 is extended by the distance of half a panel width minus the second offset. Last, if panel 44*a* is desired to be folded first with the glue tab 46 on the outside, then the actuator 94 of O.S. helix 80 is extended by the distance of half a panel minus the second offset, whereas the actuator 94 of O.S. helix 80 is extended by the distance of half a panel plus the second offset.

It is recognized that a single compound question could be asked instead of the multiple questions presented in FIG. 9. In addition, it is recognized that adjusting the servo motors 96 of the second helix assembly 80 such that either the operator side or the drive side leads is another way of placing the glue tab in the proper position.

It is recognized that the elongated helix folding assembly 76 can comprise a helix member supported on a rotatable shaft extending coaxially with the longitudinal axis of the helix member by spokes which are independently adjustable radially of said shaft to move at least a portion of the helix member relative to the shaft. Of course, the helix member would be constructed of material sufficiently flexible to allow such movement (e.g., nylon). Such adjustment of the length of the spokes would change the configuration of the helix member so that, for example, it is partly or totally in the form of a conical helix which would allow the helix member to contact a blank farther from the forward edge on long sheets and provide a further way to adjust the folding rate.

The invention may be embodied in still other specific forms without departing from the spirit or essential attributes thereof and, accordingly, reference should be made to the appended claims, rather than to the foregoing specification, as indicating the scope of the invention.

What is claimed is:

1. A device for folding paperboard blanks comprising:

folding rails for supporting the blanks traveling through the device, the folding rails defining a path of travel for the blanks;

a conveyor for conveying the blanks through the device;

a first operator side elongated helix folding assembly rotatably supported at each end;

a second operator side elongated helix folding assembly rotatably supported at each end and aligned with the first operator side helix folding assembly;

a first drive side elongated helix folding assembly rotatably supported at each end;

a second drive side elongated helix folding assembly rotatably supported at each end and aligned with the first drive side helix folding assembly;

a first actuator connected to one end of each second helix folding assembly for translating the one end of each first helix folding assembly toward and away from the blank path;

a second actuator connected to the other end of each second helix folding assembly for translating the other end of each second helix folding assembly above and below the blank path; and a servo motor connected to each helix folding assembly for rotating the respective helix folding assembly, each servo motor comprising a resolver; and an incremental motion controller which determines and stores the position of the helix folding assemblies from data obtained from the servo motor resolvers.

2. The folding device according to claim 1, further comprising a third actuator connected to one end of each first helix folding assembly for translating the one end of each first helix folding assembly toward and away from the blank path;

a fourth actuator connected to the other end of each first helix folding assembly for translating the other end of each first helix folding assembly above and below the blank path.

3. The folding device of claim 2, wherein each helix folding assembly comprises a shaft, spokes extending from the shaft, and a helical blank contacting member supported by the spokes.

4. The folding device of claim 3, wherein the servo motor is connected to the shaft of each helix folding assembly.

5. The folding device of claim 4, further comprising a target disposed on each helix folding assembly and a proximity sensor located adjacent each helix folding assembly which detects its associated target for determining the position of each helix folding assembly.

6. The folding device of claim 1, further comprising a target disposed on each helix folding assembly and a proximity sensor located adjacent each helix folding assembly which detects its associated target for determining the home position of each helix folding assembly.

7. The folding device of claim 1, wherein each helix folding assembly comprises a shaft, spokes extending from the shaft, and a helical blank contacting member supported by the spokes.

8. The folding device of claim 7, wherein the servo motor is connected to the shaft of each helix folding assembly.

9. The folding device of claim 8, further comprising a target disposed on each helix folding assembly and a proximity sensor located adjacent each helix folding assembly which detects its associated target for determining the home position of each helix folding assembly.

10. A device for folding paperboard blanks comprising:

folding rails for supporting the blanks traveling through the device, the folding rails defining a path of travel for the blanks;

a conveyor for conveying the blanks through the device;

a first operator side elongated helix folding assembly rotatably supported at each end;

a second operator side elongated helix folding assembly rotatably supported at each end and aligned with the first operator side helix folding assembly;

a first drive side elongated helix folding assembly rotatably supported at each end;

a second drive side elongated helix folding assembly rotatably supported at each end and aligned with the first drive side helix folding assembly;

a first actuator connected to one end of each second helix folding assembly for translating the one end of each first helix folding assembly toward and away from the blank path;

a second actuator connected to the other end of each second helix folding assembly for translating the other end of each second helix folding assembly above and below the blank path;

a third actuator connected to one end of each first helix folding assembly for translating the one end of each first helix folding assembly toward and away from the blank path;

a fourth actuator connected to the other end of each second helix folding assembly for translating the other end of each first helix folding assembly above and below the blank path;

a servo motor connected to each helix folding assembly for rotating the respective helix folding assembly, each servo motor comprising a resolver;

an incremental motion controller which determines and stores the home position of the helix folding assemblies from data obtained from the servo motor resolvers; and a target disposed on each helix folding assembly and a proximity sensor located adjacent each helix folding assembly which detects its associated target for determining the position of each helix folding assembly.

11. A device for folding paperboard blanks comprising:

folding rails for supporting the blanks traveling through the device, the folding rails defining a path of travel for the blanks;

a conveyor for conveying the blanks through the device;

an operator side elongated helix folding assembly rotatably supported at each end;

a drive side elongated helix folding assembly rotatably supported at each end;

each helix folding assembly having a servo motor connected to it for rotating the helix folding assembly about a longitudinal axis, each servo motor comprising a resolver; and an incremental motion controller which determines and stores the rotational position of the helix folding assemblies from data obtained from the servo motor resolvers.

12. The folding device of claim 11, further comprising a target on each helix folding assembly and a proximity sensor located adjacent each helix folding assembly which detects its associated target for determining a reference rotational position of each helix folding assembly.

13. A device for folding paperboard blanks comprising:

a conveyor for conveying the blanks through the device;

an operator side elongated helix folding assembly rotatably supported at each end;

a drive side elongated helix folding assembly rotatably supported at each end;

servo drive means for rotating each helix folding assembly about a longitudinal axis, a resolver associated with the servo drive means for each helix folding assembly; and, an incremental motion controller which determines and stores the rotational positions of each of the helix folding assemblies from data obtained from the resolvers.

* * * * *